United States Patent [19]

Numbers

[11] 4,438,853

[45] Mar. 27, 1984

[54] ROTATING STORAGE RACK FOR BABY FOOD CONTAINERS

[75] Inventor: Jody L. Numbers, Scottsdale, Ariz.

[73] Assignee: Monterey Laboratories, Inc., Las Vegas, Nev.

[21] Appl. No.: 325,005

[22] Filed: Nov. 25, 1981

[51] Int. Cl.[3] ..... A47B 73/00

[52] U.S. Cl. ..... 211/77; 108/25; 108/94; 108/96; 248/165; 211/163

[58] Field of Search ..... 211/77, 78, 129, 131, 211/81, 85, 163; 108/93, 94, 95, 96, 101, 25; 403/346, 347, 254; 248/165, 158, 174, 121

[56] References Cited

U.S. PATENT DOCUMENTS

| | | | |
|---|---|---|---|
| 47,831 | 5/1865 | Hussey | 108/96 X |
| 663,046 | 12/1900 | Schaeffer | 211/163 |
| 1,247,195 | 11/1917 | Willett | 211/78 |
| 1,759,140 | 5/1930 | Silberger | 211/77 |
| 2,946,456 | 7/1960 | Liguori | 211/77 |
| 3,102,638 | 9/1963 | Saunders | 248/121 X |
| 3,806,124 | 4/1974 | Heiko | 108/111 X |
| 3,858,529 | 1/1975 | Salladay | 211/163 X |

*Primary Examiner*—Francis K. Zugel
*Assistant Examiner*—Peter A. Aschenbrenner
*Attorney, Agent, or Firm*—Harris Zimmerman; Howard Cohen

[57] ABSTRACT

A rotating rack for baby food jars and the like includes a base member, a plurality of disk-like shelf units, and a plurality of vertical support members. Any of the shelf units may be secured to the base member and supported thereon in freely rotating fashion. Each of the shelf units include slots therein to engage the vertical support members. The lower ends of the vertical members are releasably secured in the slots of the rotatably supported shelf unit. The vertical members also include a plurality of detents spaced vertically therealong to secure the remaining shelves at selected spacing intervals. Each shelf includes a plurality of generally circular depressions formed therein and spaced thereabout to engage the bottom portions of jars of comestible substances. The shelf spacing may be selectively altered to accommodate containers of differing heights.

10 Claims, 10 Drawing Figures

ROTATING STORAGE RACK FOR BABY FOOD CONTAINERS

BACKGROUND OF THE INVENTION

The following U.S. patents comprise the closest known relevant prior art:

U.S. Pat. No. 3,805,965;
U.S. Pat. No. 874,933;
U.S. Pat. No. 117,765;
U.S. Pat. No. 1,759,140;
U.S. Pat. No. 905,975;
U.S. Pat. No. 2,534,680.

The prior art discloses various structures for displaying and storing a plurality of containers in a rotatable structure that may be turned to bring any of the containers into convenient proximity. Many of these devices employ structures for engaging the cap or neck of a jar or bottle. Others include rotatable shelves which support the bottoms of jars or bottles of comestible goods. In either case, these prior art devices are generally very substantial in construction, and are completely assembled in finished form at the time of manufacture. Thus these devices must be shipped and handled in fully assembled configuration, resulting in a great deal of wasted shipping space.

Furthermore, the prior art devices generally comprise a plurality of shelf units which are rotatable about a central axis, and are spaced apart in the axial direction by a fixed and invariable amount. Although this form of construction may suffice for containers of paint or jars of spices, it is not the optimal configuration for supporting jars of food for babies and infants. It is well known that foods prepared for babies and infants are sold in jars of varying sizes, and that as newborn children grow they require larger food portions and therefore larger jars of food. However, there is no known carousel device in the prior art which provides variable shelf spacing to accommodate the differing sizes of food containers commonly marketed for consumption by babies and infants. Nor is there known any prior art carousel device which is designed to be shipped and sold in disassembled condition, and which is easily reassembled for use.

SUMMARY OF THE PRESENT INVENTION

The present invention generally comprises a rotating rack for supporting and storing a plurality of containers of comestible substances. Its most salient features include a design which permits the rack to be easily assembled and disassembled for shipping and use. Furthermore, the rack includes shelves which are spaced at adjustable intervals to accommodate containers of differing heights.

The rotating rack is particularly adapted for baby food jars and the like and includes a base member, a plurality of disk-like shelf units, and a plurality of vertical support members. Any of the shelf units may be secured to the base member and supported thereon in freely rotating fashion. Each of the shelf units includes slots therein to engage the vertical support members. The lower ends of the vertical members are releasably secured in the slots of the rotatably supported shelf unit. The vertical members also include a plurality of detents spaced vertically therealong to secure the remaining shelves at selected spacing intervals. Each shelf includes a plurality of generally circular depressions formed therein and spaced thereabout to engage the bottom portions of jars of comestible substances. The shelf spacing may be selectively altered to accommodate containers of differing heights.

DESCRIPTION OF THE PREFERRED EMBODIMENT

The present invention generally comprises a rotatable storage rack or carousel which is adapted to support a plurality of jars of comestible substances. The preferred embodiment is particularly adapted to support a plurality of jars of foods prepared for consumption by infants. Its most salient features are that it is rotatable to bring any jar supported thereon into convenient access, it is readily assembled and disassembled for shipment, use, and storage, and it provides variably spaced shelf units to accommodate jars of differing heights.

Figure 5:
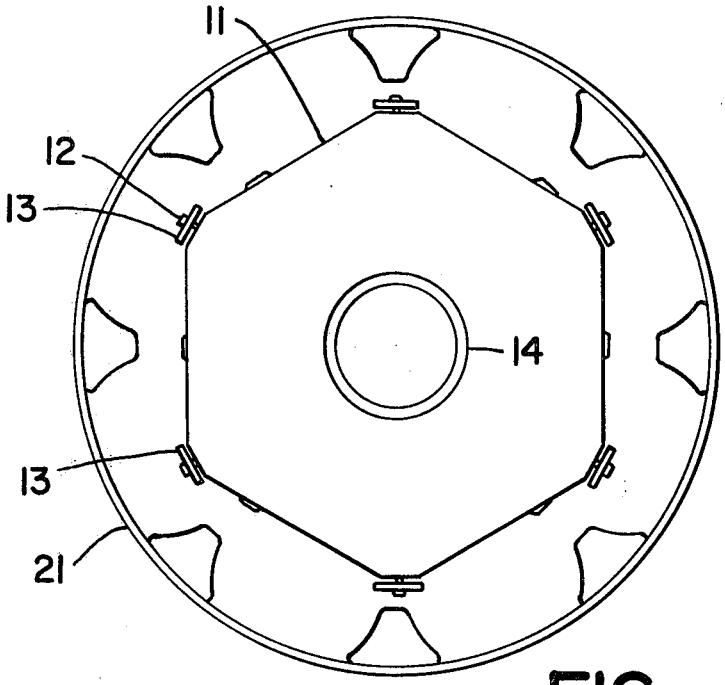
FIG. 5 is a bottom plan view of the rotatable storage rack of the present invention.

The device of the present invention includes a base member 11 which is formed in generally octagonal plan configuration, as shown, for example, in FIG. 5. The base includes a cylindrical tubular boss 14 extending upwardly therethrough and disposed concentrically with respect to the primary axis of the octagonal base. Extending outwardly from each of the vertices of the octagonal base is a short shaft 12 on which a wheel 13 is rotatably secured. The upper extents of the wheels 13 are disposed slightly higher than the top of the base member 11.

The present invention also includes a plurality of shelf units 16, each comprising a generally circular disk. Each shelf unit 16 includes a hole 17 extending therethrough and disposed concentrically with respect to the axis thereof. The hole 17 is adapted to receive the cylindrical boss 14 of the base therethrough. It may be appreciated that only the lowermost of the shelf units 16 is thus engaged by the base. However, all of the shelf units are interchangeable, and any one of them may be secured to the cylindrical boss 14.

Each of the shelf units 16 includes a plurality of generally circular depressions 18 formed therein and spaced circumferentially thereabout. The depressions 18 are dimensioned to receive and support the bottoms of jars of baby food or the like. The radially distal portions of the depressions 18 intersect with the perimeter of the disk-like shelve units 16 to facilitate removal of the jars from their respective depressions.

Extending between adjacent circular depressions 18 in each shelf unit 16 are a plurality of annular depressions 19. The annular depressions 19 are equal in depth to the depressions 18, and are disposed at a common nominal diameter. As a result, the circular depressions 18 alternating with the depressions 19 combine to form an annular surface extending continuously about each shelf unit. The bottom surface of this annular track is the surface which bears upon the wheels 13 of the base member 11, so that the shelf unit 16 which is secured to the base may rotate freely about its axis through any desired angle. It may be noted that each shelf unit 16 also includes a peripheral flange 21 extending downwardly from each shelf unit to provide additional structural rigidity thereto.

Each of the shelf units 16 also includes two pairs of slots 22 and 23, extending therethrough and disposed radially inwardly of the depressions 18 and 19. Each pair of slots 22 and 23 is disposed in diametrically opposed, parallel fashion, with the slots 22 being oriented perpendicularly with respect to the slots 23.

Figure 8:
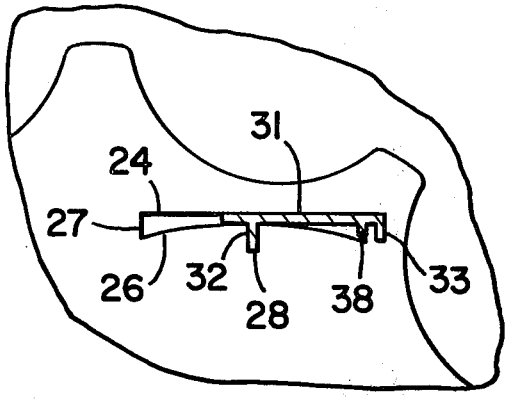
FIG. 8 is a cross-sectional view of a vertical support member, taken along line 8—8 of FIG. 7.

With reference to FIG. 8, each of the slots 22 and 23 is defined by a linear edge 24 and an arcuate edge 26 opposed thereto. The edge 26 has a shallow curvature characteristic of a large radius of curvature. The like ends of the edges 24 and 26 are joined by a pair of edges 27 which extend generally orthogonally with respect to the edge 24. Extending inwardly into a medial portion of the arcuate edge 26 is a narrow rectangular slot 28 which forms, together with the slot 22 or 23, a generally T configuration. Within the confines of the edges 24, 26, 27, and 28, the material which forms the respective shelf unit 16 is removed, either by die cutting, molding, punching, or the like.

Figure 6:
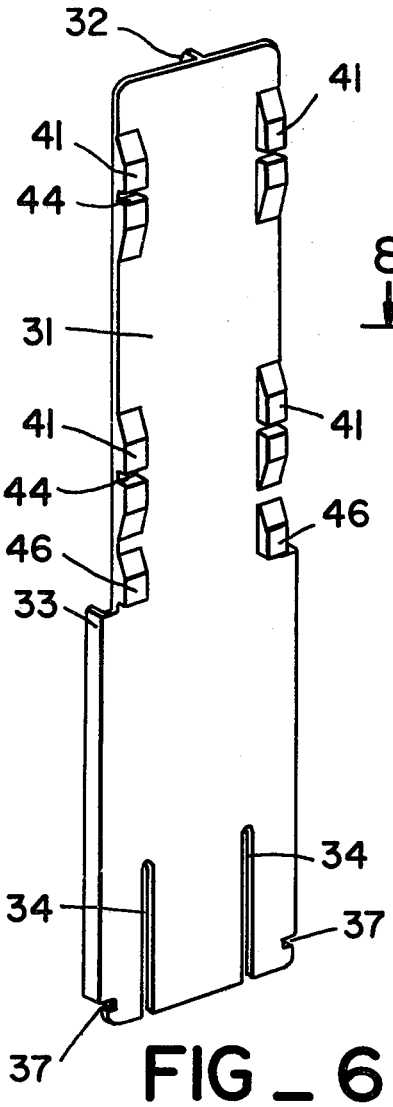
FIG. 6 is a perspective view of a vertical support member of the present invention.

The device of the present invention also includes a quartet of vertical support members 31, as shown in FIG. 6. Each vertical support member 31 comprises a generally planar web extending longitudinally and formed of a stiff plastic material or the like. A reinforcing rib 32 extends longitudinally the length of the member 31 and protrudes from the center line thereof. Each member 31 also includes a pair of opposed flanges 33 protruding orthogonally from the opposed edges of the member and extending from the lower portion to a medial portion thereof. The flanges 33 and the rib 32 generally extend in a common direction from the member.

A pair of slots 34 extend into the member 31 from the lower end thereof, and define resilient arms 36. The arms 36 may be elastically deformed inwardly toward the center line of the member 31. A detent slot 37 is formed in the lower end of each arm 36, and is disposed directly adjacent to the lower terminus of the respective flange 33. The slots 37 extend generally orthogonally with respect to the center line of the member 31. A reinforcing boss 38 extends longitudinally from the lower end of each arm 36 and is disposed directly adjacent to the terminus of the respective detent slot 37.

Figure 7:
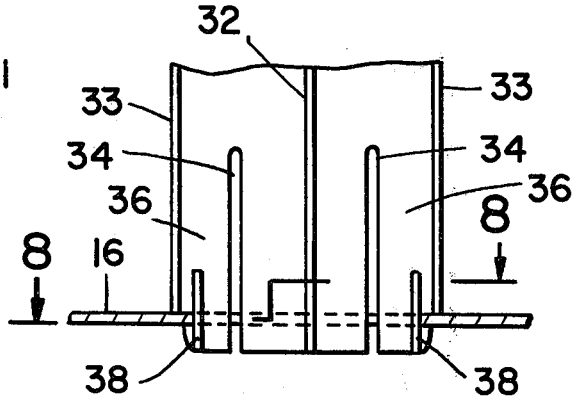
FIG. 7 is an enlarged, detailed elevation of the lower portion of a vertical support member of the present invention.

With reference to FIGS. 7 and 8, the lower end portion of any of the vertical support members 31 is adapted to be releasably engaged in any of the slots 22 or 23 of any of the shelf units 16. The arms 36 may be deformed inwardly so that the lower portions thereof may be inserted through either of the slots 22 or 23. At the same time, the central rib 32 is inserted into the portion 28 of the slot. When the arms 36 are released they resiliently move outwardly so that the detent slots 37 engage the edge portions 27 of the slot 22 or 23. The slot 22 or 23 provides sufficient clearance for the reinforcing bosses 38 adjacent to the slots 37. The engagement of the rib 32 in the slot portion 28, together with the impingement of the lower ends of the flanges 33 on the surface of the shelf unit 16, combine to produce a rigid support of the member 31 by the shelf unit.

Figure 9:
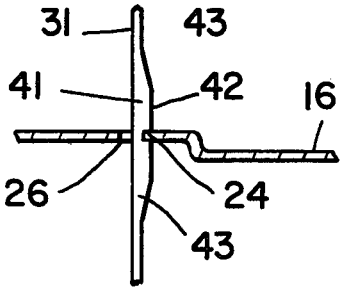
FIG. 9 is an enlarged, detailed cross-sectional elevation of a shelf-detent assembly of the present invention.

Each vertical support member 31 also includes a plurality of detent assemblies 41 for supporting the shelf units 16. Each detent assembly 41 comprises a boss extending outwardly from the plane of the web of the member 31 in a direction opposite to the rib 32 and flanges 33. Each boss 41 includes a generally planar face 42 which is generally parallel to the member 31 with ramp surfaces 43 extending smoothly and obliquely from the surface of the member 31 to the face 42. Disposed medially in the face 42 is a detent slot 44 which extends generally orthogonally with respect to the center line of the member 31. The slot 44 is adapted to engage the edge portion 24 of one of the slots 22 or 23 to support the shelf unit 16 thereby, as shown in FIG. 9. Indeed, the ramp portions 43, as they are inserted through the slot 22 or 23, cause the edge portions 24 and 26 to deform resiliently so that the edge 24 will snappingly engage the slot 44. This engagement will be maintained indefinitely, and can be released easily by deforming the web of the member 31 in the transverse direction so that the edge portion 24 may be removed from the slot 44.

Two pairs of detent members 41 are provided on each member 31, one pair being disposed at the upper end portion of the member and the other pair being disposed adjacent to the medial portion of the member. Each pair is laterally spaced at opposed edges of the member 31.

Figure 10:
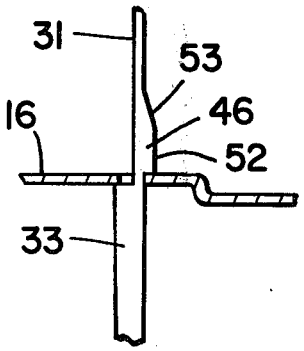
FIG. 10 is an enlarged, detailed cross-sectional elevation of a vertical support shelf stop of the present invention.

Disposed directly adjacent to the upper terminus of the flanges 33 is a pair of detents 46, as shown in FIGS. 6 and 10. Each detent 46 essentially comprises one half of a detent member 44; i.e. there is provided a flat face 52 and a ramp portion 53 extending smoothly and obliquely from the member 31 to the face 52. The lower edge of the detent face 52 extends generally orthogonally from the web of the member 31 and is adapted to engage the edge portion 24 of one of the slots 22 or 23. The lower edge of the detent 52 is positioned so that it engages the upper surface of a shelf unit 16 at the same time that the upper terminus of the flanges 33 engage the lower surface of the shelf unit 16 in supporting fashion. The detent 52 may be engaged and disengaged as described with respect to the detents 41.

It should be noted that the slots 22 or 23 of the shelf units are disposed orthogonally each with respect to the other, and that the vertical supports are likewise oriented with the webs thereof disposed in orthogonal relationship. This arrangement minimizes wobbling and instability of the upper shelf units.

Figure 1:
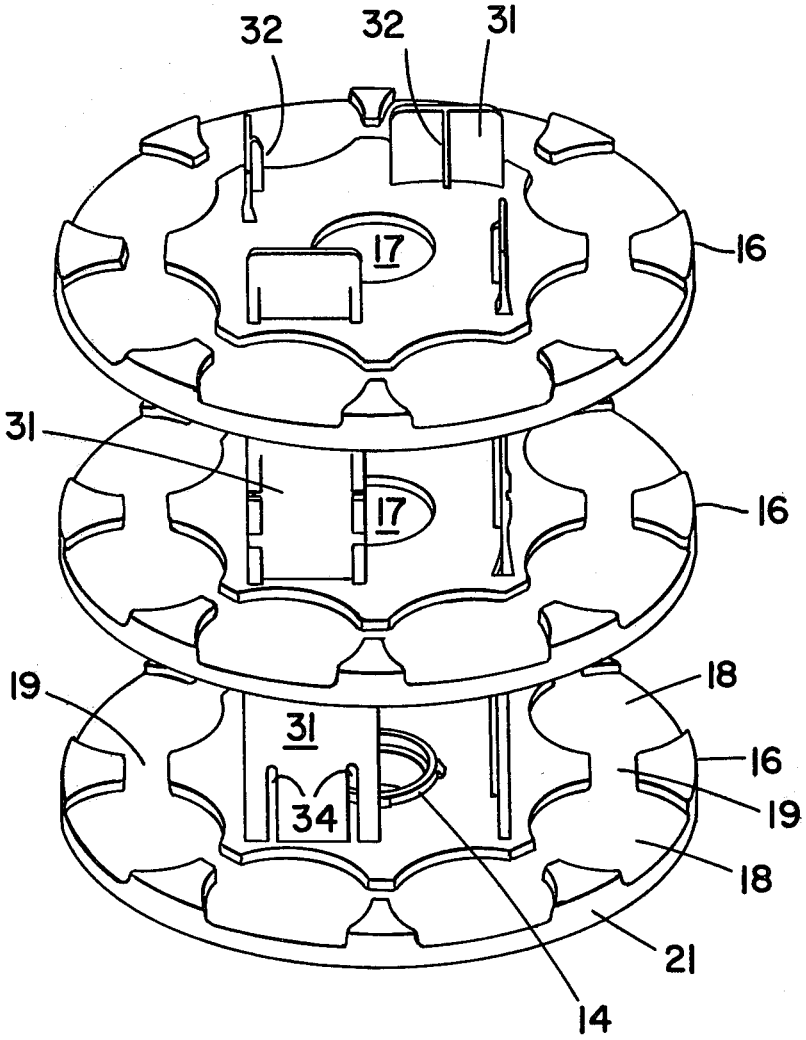
FIG. 1 is a perspective view of the rotatable storage rack of the present invention.
Figure 3:
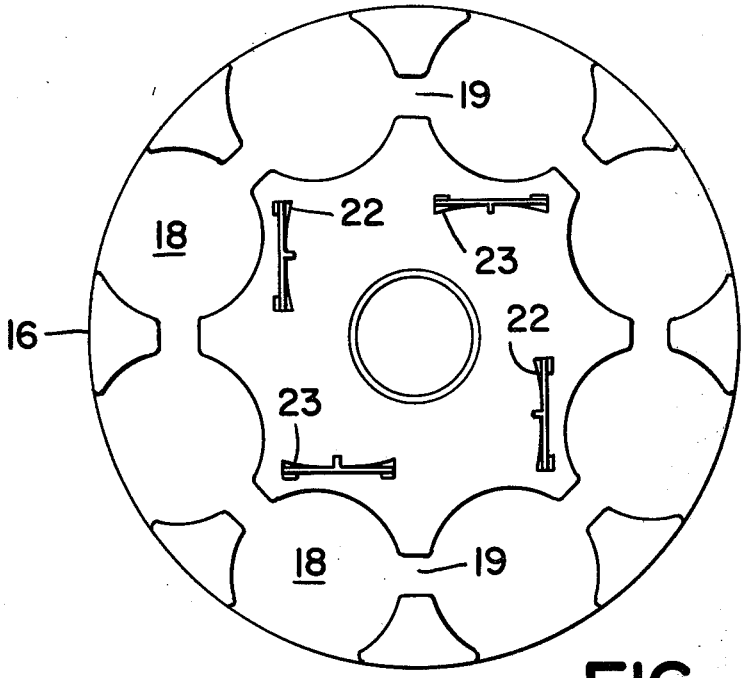
FIG. 3 is a plan view of the rotatable storage rack of the present invention.
Figure 2:
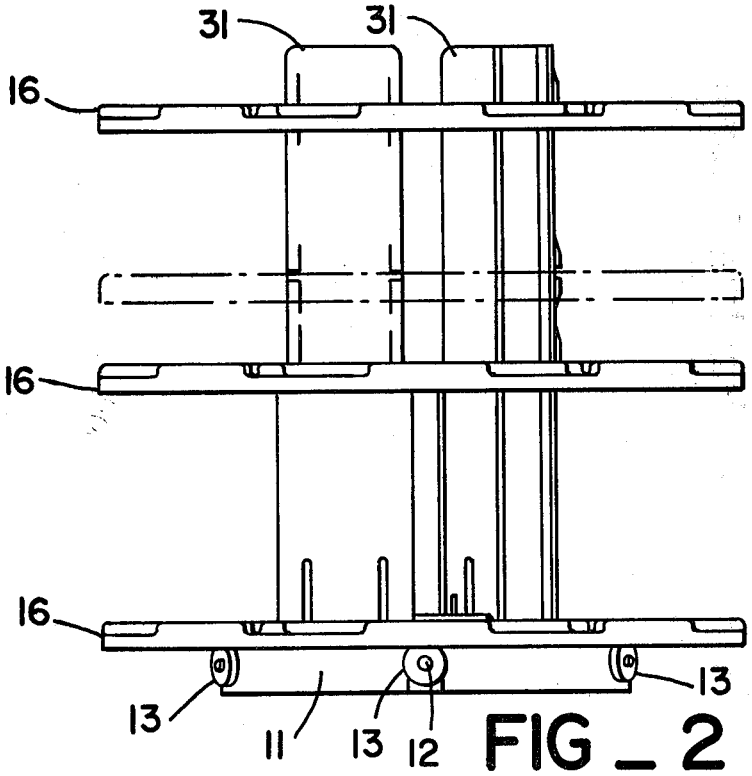
FIG. 2 is a side elevation of the rotatable storage rack of the present invention.
Figure 4:
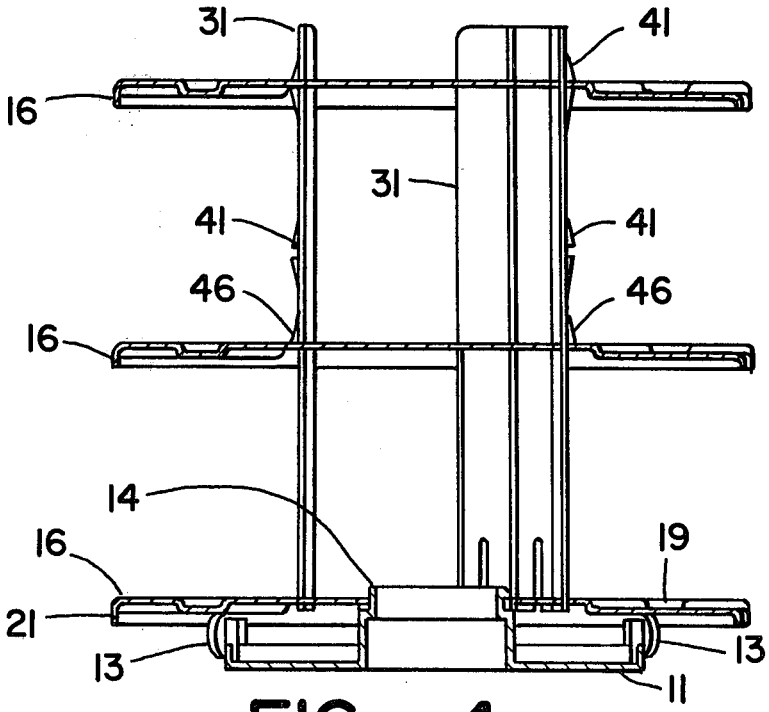
FIG. 4 is a cross-sectional elevation of the rotatable storage rack of the present invention.

A salient feature of the present invention is that it is easily assembled and disassembled for transportation, storage, and use. To assemble the present invention, it is necessary first to select any one of the shelf units 16 and place it so that the cylindrical boss 14 of the base 11 extends through the hole 17 thereof. In this disposition the shelf unit assembled to the base is rotatably supported by the plurality of wheels 13. The next step in the assembly is to engage the lower ends of all of the vertical support members 31 in the slots 22 and 23 of the shelf unit 16 which is secured to the base 11, as shown in FIGS. 2 and 4. Next, one of the remaining shelf units 16 is secured to the vertical support members 31 by inserting the upper ends of the members 31 through the lower openings of the slots 22 and 23 of the shelf unit 16, so that the shelf unit is translated downwardly onto the support members 31. The shelf unit is moved downwardly past the detent assemblies 44 to engage the detent assemblies 46 and be supported by the upper ends of the flanges 33. As a final step, the remaining shelf unit 16 is likewise translated downwardly onto the members 31 so that they extend through the slots 22 and 23 and engage the uppermost set of detents 44.

It may be appreciated that the medial shelf unit 16, as viewed in FIGS. 2 or 4, may be selectively released from the detents 46 and secured to the lowermost set of detent assemblies 41, as shown in phantom line in FIG. 2. In this configuration, the spacing between the lowermost shelf unit and the medial shelf unit 16 is increased, so that the lowermost shelf unit 16 may have sufficient clearance to support jars of babyfood and the like which are taller and more capacious.

It may be appreciated that the present invention may be shipped in a very compact package in knocked-down fashion, thus saving shipping volume and cost. Furthermore, the present invention comprises a total of eight separate pieces, so that it is very easy to reassemble and use. Also, it should be emphasized that any of the shelf units 16 may be interchanged with any of the other shelf units so that assembly of the completed unit is virtually fool-proof.

I claim:

1. A rotating rack for supporting a plurality of containers, comprising; a base member, a plurality of shelf units, a plurality of vertical support members, means for supporting one of said shelf units on said base member in freely rotating fashion, means for securing said vertical support members to said one shelf unit for rotation in common therewith, and means for securing the remainder of said plurality of shelf units to said vertical support members in vertically spaced relationship, each of said shelf units comprising a generally disc-like panel, and a plurality of container-engaging depressions formed in said panel and spaced thereabout to engage the lower portions of said containers, said depressions being joined by a plurality of interconnecting channel depressions interposed therebetween, said means for supporting one of said shelf units on said base in freely rotating fashion including a plurality of rollers extending from said base member and adapted to impinge on the lower surface of said one shelf unit, said container-engaging depressions and said interconnecting channel depressions forming on said lower surface a continuous closed curved flat of substantially planar, ring-like configuration, said rollers engaging said closed curved flat to support said one shelf unit in freely rotating fashion.

2. The rotating rack of claim 1, wherein said plurality of shelf units are substantially identical.

3. The rotating rack of claim 1, wherein said means for securing said vertical members and said means for securing the remainder of said plurality of shelf units both include a plurality of slots disposed in each of said shelf units.

4. The rotating rack of claim 3, wherein each of said slots are defined by a linear edge, an arcuate edge disposed opposite said linear edge and extending convexly toward said linear edge, and side edges joining like ends of said linear edge and said arcuate edge.

5. The rotating rack of claim 3, wherein said means for securing said vertical support members includes a pair of detent slots formed in the lower end of each of said vertical support members and disposed to releasably engage said side edges of one of said slots.

6. The rotating rack of claim 5, further including a pair of resiliently deformable arms disposed at said lower end of each of said vertical support members, said detent slots being disposed in said deformable arms.

7. The rotating rack of claim 3, wherein said means for supporting said remainder of said shelf units includes a plurality of detent members formed on said vertical support members and adapted to engage said slots of said shelf units.

8. The rotating rack of claim 7, wherein said detent members each include a boss extending outwardly from a vertical support member, said boss having a generally flat outer face, a detent groove formed in said face and adapted to engage an edge portion of one of said slots.

9. The rotating rack of claim 1, wherein said vertical support members each comprise an upwardly extending web member, and a pair of flanges protruding in orthogonal fashion from opposed edges of said web member and extending from the lower end of each vertical support member to a medial portion thereof, the upper terminus of each of said pair of flanges being disposed to support one of said shelf units.

10. The rotating rack of claim 9, further including a reinforcing rib protruding from the midline of each of said vertical support members and extending the length thereof.

* * * * *